US009939761B2

(12) United States Patent
Nozawa et al.

(10) Patent No.: US 9,939,761 B2
(45) Date of Patent: Apr. 10, 2018

(54) FIXING DEVICE AND IMAGE FORMING APPARATUS THAT INCLUDE A SEPARATION AID DISPOSED DOWNSTREAM FROM THE FIXING NIP

(71) Applicants: Kenji Nozawa, Kanagawa (JP); Masahiko Satoh, Tokyo (JP); Masami Okamoto, Kanagawa (JP); Keisuke Kubota, Kanagawa (JP); Yuuki Kikushima, Kanagawa (JP); Shuutaroh Yuasa, Kanagawa (JP); Fumihiro Hirose, Kanagawa (JP); Kensuke Yamaji, Kanagawa (JP); Kaori Hemmi, Kanagawa (JP)

(72) Inventors: Kenji Nozawa, Kanagawa (JP); Masahiko Satoh, Tokyo (JP); Masami Okamoto, Kanagawa (JP); Keisuke Kubota, Kanagawa (JP); Yuuki Kikushima, Kanagawa (JP); Shuutaroh Yuasa, Kanagawa (JP); Fumihiro Hirose, Kanagawa (JP); Kensuke Yamaji, Kanagawa (JP); Kaori Hemmi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 156 days.

(21) Appl. No.: 14/924,206

(22) Filed: Oct. 27, 2015

(65) Prior Publication Data

US 2016/0139549 A1 May 19, 2016

(30) Foreign Application Priority Data

Nov. 13, 2014 (JP) ..... 2014-230853

(51) Int. Cl.
*G03G 15/20* (2006.01)
*G03G 15/00* (2006.01)
*G03G 21/16* (2006.01)

(52) U.S. Cl.
CPC ..... *G03G 15/2028* (2013.01); *G03G 15/2017* (2013.01); *G03G 15/2064* (2013.01);
(Continued)

(58) Field of Classification Search
CPC ..... G03G 15/2017; G03G 15/2028; G03G 15/2085; G03G 15/6573; G03G 21/1685;
(Continued)

(56) References Cited

U.S. PATENT DOCUMENTS

2008/0044203 A1* 2/2008 Ukai ..... G03G 21/1647 399/167
2011/0079354 A1* 4/2011 Barton ..... G03G 15/2028
(Continued)

FOREIGN PATENT DOCUMENTS

JP 2003-005566 1/2003
JP 2008-134356 6/2008
(Continued)

*Primary Examiner* — Joseph S Wong
(74) *Attorney, Agent, or Firm* — Oblon, McClelland, Maier & Neustadt, L.L.P.

(57) ABSTRACT

A fixing device includes an endless fixing belt stretched taut across a first roller and a second roller and rotatable in a predetermined direction of rotation. A pressure rotator is pressed against the first roller via the fixing belt to form a fixing nip between the pressure rotator and the fixing belt, through which a recording medium is conveyed. A separation aid, disposed downstream from the fixing nip in the direction of rotation of the fixing belt to separate the recording medium from the fixing belt, includes a contact face contacting an inner circumferential surface of the fixing belt and a bulge disposed at a center of the contact face in a longitudinal direction of the separation aid. The bulge
(Continued)

projects toward the inner circumferential surface of the fixing belt relative to each lateral end of the contact face in the longitudinal direction of the separation aid.

18 Claims, 6 Drawing Sheets

(52) U.S. Cl.
CPC ..... *G03G 15/2085* (2013.01); *G03G 15/6573* (2013.01); *G03G 21/1685* (2013.01); *G03G 2215/2029* (2013.01); *G03G 2215/2038* (2013.01)

(58) Field of Classification Search
CPC ... G03G 2215/2022; G03G 2215/2029; G03G 2215/2038
See application file for complete search history.

(56) References Cited

U.S. PATENT DOCUMENTS

| | | | | |
|---|---|---|---|---|
| 2011/0081173 | A1* | 4/2011 | Watanabe ..... | G03G 15/2064 399/323 |
| 2011/0142507 | A1* | 6/2011 | Sasaki ..... | G03G 15/2032 399/331 |
| 2015/0253708 | A1 | 9/2015 | Hirose et al. | |
| 2015/0261154 | A1 | 9/2015 | Nozawa et al. | |

FOREIGN PATENT DOCUMENTS

| | | |
|---|---|---|
| JP | 2014-074879 | 4/2014 |
| JP | 2015-069041 | 4/2015 |

* cited by examiner

FIXING DEVICE AND IMAGE FORMING APPARATUS THAT INCLUDE A SEPARATION AID DISPOSED DOWNSTREAM FROM THE FIXING NIP

CROSS-REFERENCE TO RELATED APPLICATION

This patent application is based on and claims priority pursuant to 35 U.S.C. § 119 to Japanese Patent Application No. 2014-230853, filed on Nov. 13, 2014, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a first roller and a second roller. The first roller includes a surface elastic layer. An endless fixing belt is stretched taut across the first roller and the second roller and rotatable in a predetermined direction of rotation. A pressure rotator is pressed against the first roller via the fixing belt to form a fixing nip between the pressure rotator and the fixing belt, through which a recording medium is conveyed. A separation aid is disposed downstream from the fixing nip in the direction of rotation of the fixing belt to separate the recording medium from the fixing belt. The separation aid includes a contact face contacting an inner circumferential surface of the fixing belt and a bulge disposed at a center of the contact face in a longitudinal direction of the separation aid. The bulge projects toward the inner circumferential surface of the fixing belt relative to each lateral end of the contact face in the longitudinal direction of the separation aid.

This specification further describes an improved image forming apparatus that includes an image bearer to bear a toner image and a fixing device, disposed downstream from the image bearer in a recording medium conveyance direction, to fix the toner image on a recording medium. The fixing device includes a first roller and a second roller. The first roller includes a surface elastic layer. An endless fixing belt is stretched taut across the first roller and the second roller and rotatable in a predetermined direction of rotation. A pressure rotator is pressed against the first roller via the fixing belt to form a fixing nip between the pressure rotator and the fixing belt, through which the recording medium is conveyed. A separation aid is disposed downstream from the fixing nip in the direction of rotation of the fixing belt to separate the recording medium from the fixing belt. The separation aid includes a contact face contacting an inner circumferential surface of the fixing belt and a bulge disposed at a center of the contact face in a longitudinal direction of the separation aid. The bulge projects toward the inner circumferential surface of the fixing belt relative to each lateral end of the contact face in the longitudinal direction of the separation aid.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION

Figure 1:
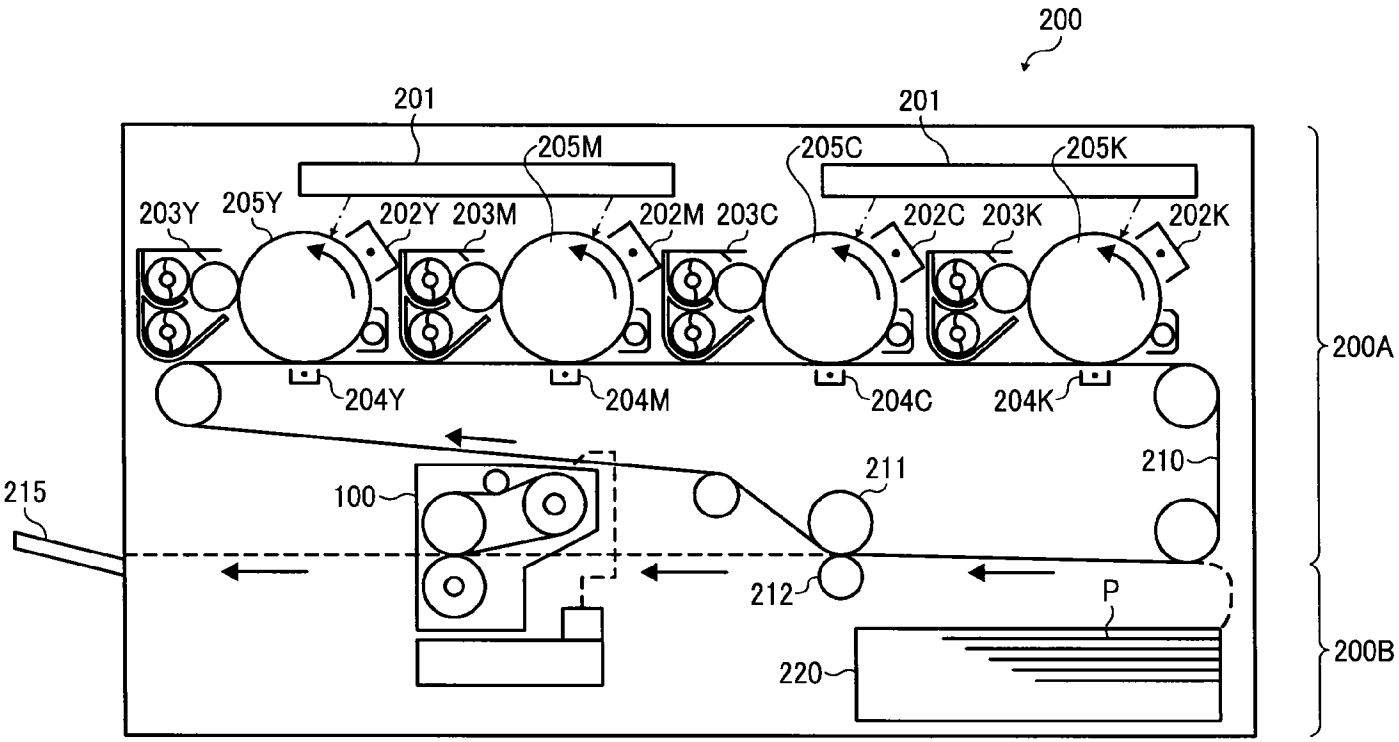
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 200 according to an exemplary embodiment of the present disclosure is explained.

FIG. 1 is a schematic vertical sectional view of the image forming apparatus 200. The image forming apparatus 200 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 200 is a color copier that forms color and monochrome toner images on recording media by electrophotography. Alternatively, the image forming apparatus 200 may be a monochrome copier that forms monochrome toner images.

With reference to FIG. 1, a description is provided of a construction of the image forming apparatus 200.

As shown in FIG. 1, the image forming apparatus 200 is a tandem color copier. The image forming apparatus 200 includes an image forming device 200A situated in a center portion of the image forming apparatus 200, a sheet feeder 200B situated below the image forming device 200A, and an image reader situated above the image forming device 200A.

A detailed description is now given of a construction of the image forming device 200A.

The image forming device 200A includes a fixing device 100 and a transfer belt 210 having a transfer face extending horizontally in FIG. 1. An upper face of the transfer belt 210 is disposed opposite components that form toner images in complementary colors created based on separation colors.

For example, photoconductors 205Y, 205M, 205C, and 205K, serving as image bearers that bear yellow, magenta, cyan, and black toner images in the complementary colors, respectively, are aligned along the transfer face of the transfer belt 210.

Each of the photoconductors 205Y, 205M, 205C, and 205K is a drum rotatable counterclockwise in FIG. 1 in an identical direction. The photoconductors 205Y, 205M, 205C, and 205K are surrounded by optical writing devices 201, chargers 202Y, 202M, 202C, and 202K, developing devices 203Y, 203M, 203C, and 203K, primary transfer devices 204Y, 204M, 204C, and 204K, and cleaners, respectively, which perform image formation processes as the photoconductors 205Y, 205M, 205C, and 205K rotate.

The developing devices 203Y, 203M, 203C, and 203K contain yellow, magenta, cyan, and black toners, respectively.

The transfer belt 210 looped over a driving roller and a plurality of driven rollers is disposed opposite the photoconductors 205Y, 205M, 205C, and 205K and rotatable clockwise in FIG. 1. A roller 211, that is, one of the plurality of driven rollers, is disposed opposite a transfer roller 212 via the transfer belt 210. A conveyance path extends horizontally from the transfer roller 212 to the fixing device 100 to convey a sheet P.

A detailed description is now given of a construction of the sheet feeder 200B.

The sheet feeder 200B includes a paper tray 220 that loads a plurality of sheets P serving as recording media and a feed device that separates an uppermost sheet P from other sheets P loaded in the paper tray 220 and conveys the sheet P to the transfer roller 212.

A description is provided of an image forming operation to form a toner image on a sheet P that is performed by the image forming apparatus 200 having the construction described above.

The charger 202Y uniformly changes an outer circumferential surface of the photoconductor 205Y. The optical writing device 201 forms an electrostatic latent image on the photoconductor 205Y according to image data sent from an image reader. The developing device 203Y containing yellow toner visualizes the electrostatic latent image into a yellow toner image. The primary transfer device 204Y applied with a predetermined bias primarily transfers the yellow toner image formed on the photoconductor 205Y onto the transfer belt 210.

Similarly, magenta, cyan, and black toner images are formed on the photoconductors 205M, 205C, and 205K, respectively, and primarily transferred onto the transfer belt 210 successively by an electrostatic force such that the yellow, magenta, cyan, and black toner images are superimposed on a same position on the transfer belt 210, thus forming a color toner image on the transfer belt 210.

The roller 211 and the transfer roller 212 secondarily transfer the color toner image formed on the transfer belt 210 onto the sheet P conveyed from the paper tray 220. The sheet P bearing the color toner image is conveyed further to the fixing device 100 where the color toner image is fixed on the sheet P as the sheet P passes through the fixing device 100.

The sheet P ejected from the fixing device 100 is conveyed onto a stacker 215 through an output path.

Figure 2:
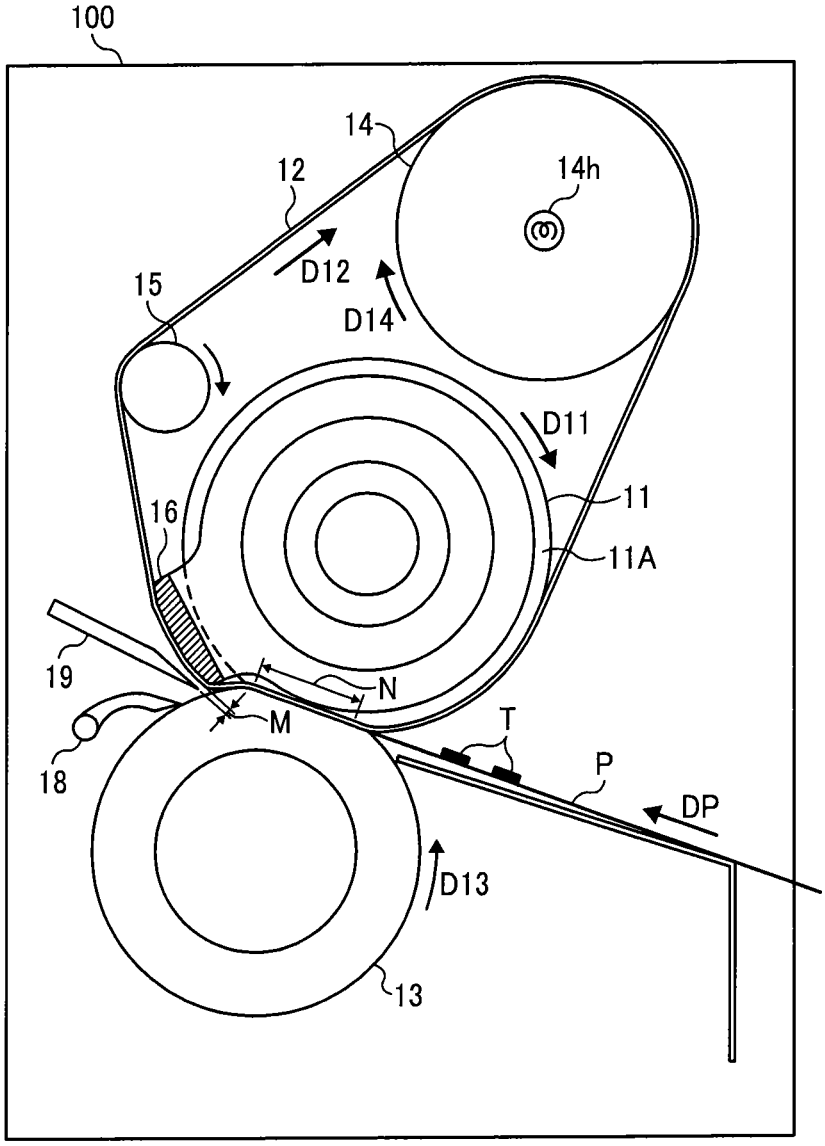
FIG. 2 is a schematic vertical sectional view of a fixing device incorporated in the image forming apparatus shown in FIG. 1.

With reference to FIG. 2, a description is provided of a construction of the fixing device 100 incorporated in the image forming apparatus 200 described above.

FIG. 2 is a schematic vertical sectional view of the fixing device 100. As shown in FIG. 2, the fixing device 100 (e.g., a fuser or a fusing unit) includes a fixing roller 11, a fixing belt 12 serving as a first nip formation member, a fixing rotator, or a fixing member, a pressure roller 13 serving as a second nip formation member, a pressure rotator, or a pressure member, a heating roller 14, a heater 14*h*, a tension roller 15, a separation aid 16, a separator 19, and a separation claw 18.

A detailed description is now given of a configuration of the fixing roller 11.

The fixing roller 11 is constructed of a cored bar made of metal and an elastic layer 11A coating the cored bar and made of silicone rubber. Alternatively, the elastic layer 11A may be made of silicone rubber foam to reduce heat absorbed into the fixing belt 12 and thereby shorten a warm-up time to warm up the fixing belt 12 to a target temperature.

A detailed description is now given of a configuration of the fixing belt 12.

The fixing belt 12 is looped over and stretched taut across the fixing roller 11 and the heating roller 14 with a predetermined tension. The fixing belt 12 is a double layered endless belt in cross-section constructed of a base layer made of nickel, stainless steel, polyimide, or the like and an elastic layer made of silicone rubber or the like.

A detailed description is now given of a construction of the pressure roller 13.

The pressure roller 13 is disposed opposite and pressed against the fixing roller 11 via the fixing belt 12 to form a fixing nip N between the pressure roller 13 and the fixing belt 12 while the pressure roller 13 rotates in a rotation direction D13 and the fixing belt 12 rotates in a rotation direction D12.

The pressure roller 13 is a tube constructed of a cored bar made of aluminum, iron, or the like and an elastic layer coating the cored bar and made of silicone rubber or the like. A pressurization assembly moves the pressure roller 13 toward the fixing belt 12 to press the pressure roller 13 against the fixing belt 12 and moves the pressure roller 13 away from the fixing belt 12 to release pressure exerted by the pressure roller 13 to the fixing belt 12. As the fixing device 100 is actuated, the pressurization assembly presses the pressure roller 13 against the fixing belt 12 with predetermined pressure.

According to this exemplary embodiment, the pressure roller 13 is used as a pressure rotator. Alternatively, an endless belt looped over a plurality of rollers (e.g., two rollers) may be used as a pressure rotator.

A detailed description is now given of a configuration of the heating roller 14.

The heating roller 14 is a hollow roller made of aluminum or iron and accommodating the heater 14*h* (e.g., a halogen heater) serving as a heater or a heat source. Alternatively, the heater 14*h* may be an induction heater (IH). Further, the heater 14*h* may be disposed opposite an outer circumferential surface of the fixing belt 12. The heating roller 14 is rotatable in a rotation direction D14.

A detailed description is now given of a configuration of the separation aid 16.

The separation aid 16 disposed opposite an inner circumferential surface of the fixing belt 12 is situated in proximity to and downstream from the fixing nip N in the rotation direction D12 of the fixing belt 12. The separation aid 16 includes a metal body and a fluorine sheet coating a surface of the metal body. Alternatively, the metal body may be treated with fluorine coating. The separation aid 16 decreases a radius of curvature of the fixing belt 12 at a portion of the fixing belt 12 situated in proximity to and downstream from the fixing nip N in the rotation direction D12 of the fixing belt 12. Accordingly, the fixing belt 12 has an increased curvature, facilitating separation of the sheet P from the fixing belt 12.

A detailed description is now given of a configuration of the separator 19 and the separation claw 18.

The separator 19 is disposed downstream from the fixing nip N in a sheet conveyance direction DP with a slight gap M retained between a front edge of the separator 19 and the outer circumferential surface of the fixing belt 12 to separate the sheet P from the fixing belt 12.

The separation claw 18 is disposed downstream from the fixing nip N in the sheet conveyance direction DP to prevent the sheet P from being wound around the pressure roller 13.

As the fixing device 100 is actuated, for example, a driver drives and rotates the fixing roller 11 clockwise in FIG. 2 in a rotation direction D11 which in turn rotates the fixing belt 12 clockwise in the rotation direction D12 by friction between the fixing roller 11 and the fixing belt 12 while the tension roller 15 pressing against the fixing belt 12 exerts an appropriate tension to the fixing belt 12. Thus, the fixing belt 12 ejects the sheet P from the fixing nip N.

While the sheet P is conveyed through the fixing device 100, the pressurization assembly presses the pressure roller 13 against the fixing belt 12 to form the fixing nip N therebetween. Conversely, while the fixing device 100 is in a standby mode to wait for a print job, the pressurization assembly separates the pressure roller 13 from the fixing belt 12.

When the image forming apparatus 200 depicted in FIG. 1 receives a print job, the heater 14*h* disposed inside the heating roller 14 heats the fixing belt 12 through the heating roller 14 to a predetermined temperature (e.g., a fixing temperature appropriate to fix a toner image T on a sheet P) that is detected by a temperature detector such as a thermistor.

While the fixing belt 12 and the pressure roller 13 are driven and rotated in the rotation directions D12 and D13, respectively, the outer circumferential surface of the fixing belt 12 is heated to the predetermined temperature. As the sheet P bearing the unfixed toner image T is conveyed through the fixing nip N leftward in FIG. 2 in the sheet conveyance direction DP, the fixing belt 12 and the pressure roller 13 apply heat and pressure to the sheet P at the fixing nip N, melting and fixing the toner image T on the sheet P.

The sheet P bearing the fixed toner image T is ejected from the fixing nip N. The radius of curvature of the fixing belt 12 produced by the separation aid 16 disposed inside a loop formed by the fixing belt 12 and disposed downstream from the fixing nip N in the rotation direction D12 of the fixing belt 12 separates a leading edge of the sheet P from the fixing belt 12 by a distance not smaller than the slight gap M. Thus, the separation aid 16 separates the sheet P from the fixing belt 12.

Oil applicators disposed opposite the fixing belt 12 and the pressure roller 13 apply oil in an appropriate amount to the fixing belt 12 and the pressure roller 13, respectively. The separator 19 and the separation claw 18 disposed downstream from the fixing nip N in the sheet conveyance direction DP or the rotation direction D12 of the fixing belt 12 prevent the sheet P from being wound around the fixing belt 12 and the pressure roller 13, ejecting the sheet P from a downstream section, that is, an exit, of the fixing nip N.

A description is provided of a construction of a comparative fixing device.

Fixing devices are requested to convey recording media of various types such as thin paper and thick paper at high speed.

As thin paper having a decreased hardness is ejected from a fixing nip formed between a fixing belt and a pressure roller, the thin paper may be wound around the fixing belt and thereby jammed between the fixing belt and the pressure roller, resulting various failures. Additionally, a fixing roller is requested to have an increased diameter to increase a thermal capacity so as to convey the recording medium at high speed. Accordingly, the fixing roller may have an increased radius of curvature that degrades separation of the recording medium from the fixing belt.

The pressure roller having an increased hardness is pressed against the elastic fixing roller situated inside a loop formed by the fixing belt. A separation aid situated inside the loop formed by the fixing belt and disposed in proximity to an exit of the fixing nip separates the recording medium from the fixing belt by using the curvature of the fixing belt. Since the separation aid is situated inside the loop formed by the fixing belt, the separation aid is exerted with tension from the fixing belt. Accordingly, the separation aid is elastically deformed by the tension and therefore is not contoured in a straight shape.

If a stopper disposed inside the loop formed by the fixing belt at each lateral end of the fixing belt in an axial direction thereof strikes the fixing belt, the fixing belt may be broken. Additionally, if a curvature portion of the separation aid that separates the recording medium from the fixing belt is spaced apart from the exit of the fixing nip excessively, the recording medium may be wound around the fixing belt for an increased time period, causing blister.

To address this circumstance, the separation aid is requested to have a decreased thickness and an increased hardness to shorten a time period for which the recording medium is wound around the fixing belt. Further, the separation aid is requested to have a shape that isolates the separation aid from the stopper disposed inside the loop formed by the fixing belt to restrict skew of the fixing belt while the fixing belt rotates. Additionally, the separation aid is requested to be longer than the recording medium in a longitudinal direction of the separation aid. For example, a length of the separation aid in the longitudinal direction thereof is 320 mm or more in the fixing device that corresponds to an SRA3 size recording medium.

If the separation aid is manufactured by sintering, the separation aid may be warped substantially and therefore processing may be difficult. Further, a sintering machine may increase manufacturing costs. If the separation aid is manufactured by cutting, it may take time for processing, increasing manufacturing costs.

Figure 3:
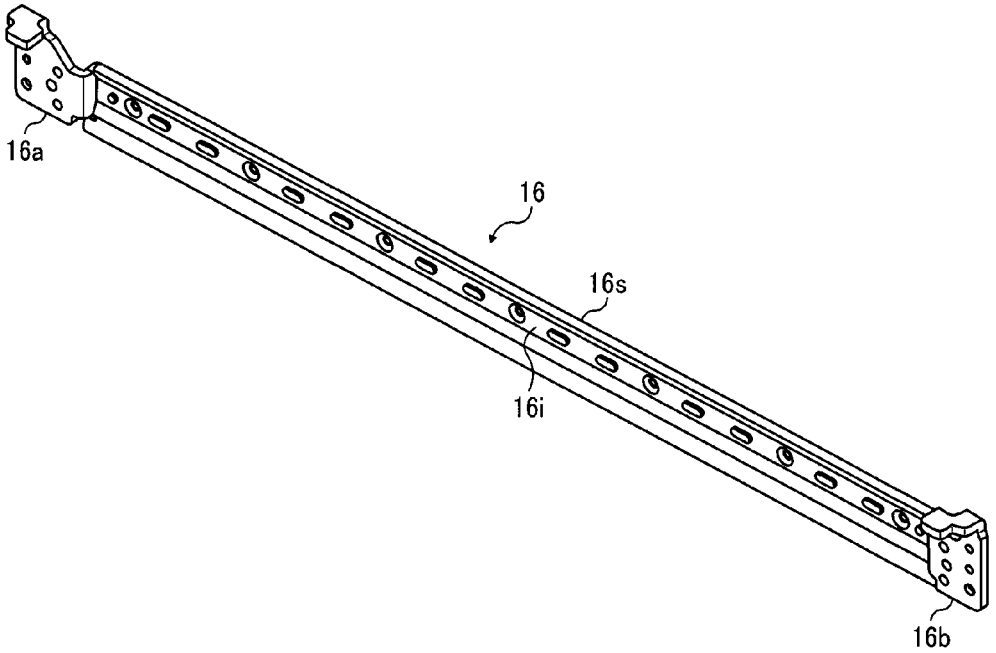
FIG. 3 is a perspective view of a separation aid incorporated in the fixing device shown in FIG. 2.
Figure 4:
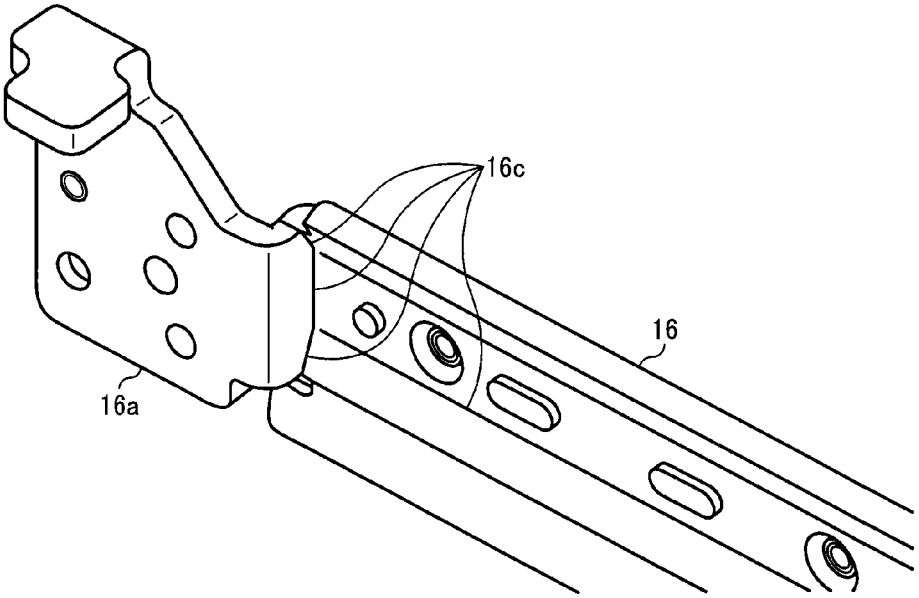
FIG. 4 is a partially enlarged perspective view of the separation aid shown in FIG. 3.

FIG. 3 is a perspective view of the separation aid 16. FIG. 4 is a partially enlarged perspective view of the separation aid 16. As shown in FIGS. 3 and 4, the separation aid 16 is made of a steel plate or a steel sheet. The separation aid 16 includes a slide face 16*s* serving as a contact face or an exterior face over which the fixing belt 12 slides, an interior face 16*i* opposite the slide face 16*s*, and bent portions 16*a* and 16*b* disposed at both lateral ends of the separation aid 16 in a longitudinal direction thereof and bent to project from the interior face 16*i* in a direction in which the bent portions 16*a* and 16*b* separate from the interior face 16*i*. Thus, the bent portions 16*a* and 16*b* of the separation aid 16 do not contact a plurality of stoppers disposed at both lateral ends of the fixing belt 12 in an axial direction thereof to prevent skew of the fixing belt 12. The bent portions 16*a* and 16*b* are produced by drawing or raising.

The steel plate includes a cold rolled steel plate. The cold rolled steel plate is manufactured by rolling without heating the steel plate. For example, the cold rolled steel plate is a steel plate made of iron or an alloy of iron that is manufactured by cold rolling, a steel plate made of iron or an alloy of iron that is manufactured by cold rolling and plating with zinc, tin, chrome, nickel, or the like, a steel plate made of stainless steel that is manufactured by cold rolling, or the like. However, the cold rolled steel plate is not limited to those steel plates. The cold rolled steel plate has a smooth surface and is manufactured with an enhanced dimensional precision, thus being appropriate as the separation aid 16.

As shown in FIG. 4, each of the bent portions 16*a* and 16*b* includes a corner portion 16*c* where the steel plate is raised. The corner portion 16*c* has a corner defined by three or more sides to enhance the hardness of the separation aid 16.

Figure 5:
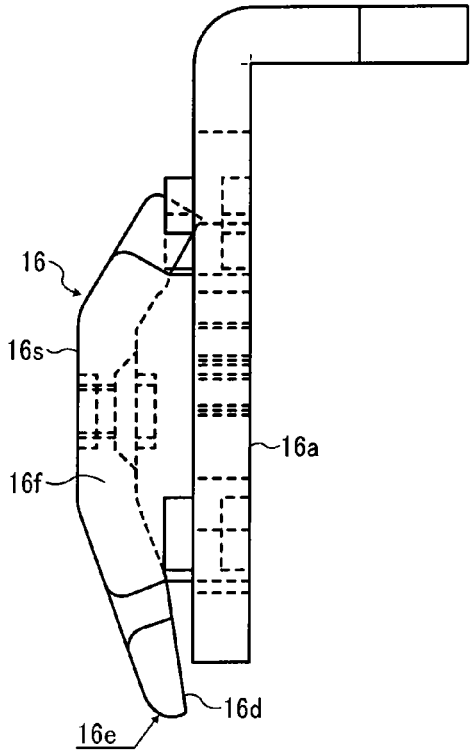
FIG. 5 is a side view of the separation aid shown in FIG. 3.

FIG. 5 is a side view of the separation aid 16. As shown in FIG. 5, the separation aid 16 further includes a front end 16*d* being contiguous to a base 16*f*. The front end 16*d* has a thickness in a direction perpendicular to the rotation direction D12 of the fixing belt 12 that gradually decreases relative to a thickness of the base 16*f*. The front end 16*d*, disposed at one end of the slide face 16*s* in the rotation direction D12 of the fixing belt 12, includes a curved face 16*e* having a roundness R defined by a radius in a range of from 1 mm to 3 mm. The curved face 16*e* is manufactured by drawing or raising.

Figure 6:
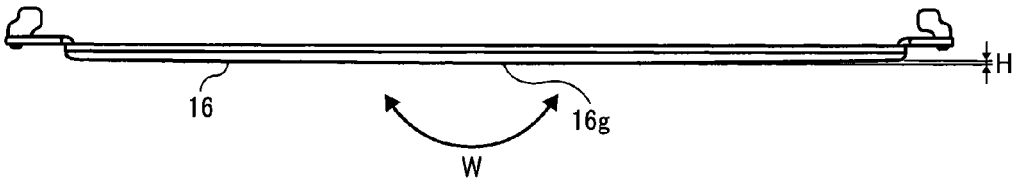
FIG. 6 is a bottom view of the separation aid seen from a bottom thereof shown in FIG. 5.

FIG. 6 is a bottom view of the separation aid 16 seen from a bottom of the separation aid 16 shown in FIG. 5. As shown in FIG. 6, the separation aid 16 further includes a bulge 16*g* (e.g., a projection) disposed at a projecting portion of the separation aid 16 that contacts the inner circumferential surface of the fixing belt 12. The bulge 16*g* is disposed at a center of the separation aid 16 in the longitudinal direction thereof parallel to the axial direction of the fixing belt 12. The bulge 16*g* projects toward the fixing belt 12 relative to both lateral ends of the separation aid 16 in the longitudinal direction thereof by a height H in a range of from 0.1 mm to 0.3 mm.

For example, the center of the slide face 16*s* of the separation aid 16 in the longitudinal direction thereof projects toward the inner circumferential surface of the fixing belt 12 relative to both lateral ends of the separation aid 16 in the longitudinal direction thereof, thus defining the bulge 16*g* warped in a warp direction W. The bulge 16*g* projects toward the fixing belt 12 so that the slide face 16*s* of the separation aid 16 is substantially planar when the separation aid 16 is elastically deformed by tension exerted from the fixing belt 12.

Accordingly, when the separation aid 16 is exerted with load from the fixing belt 12 stretched taut across the separation aid 16, the tension roller 15, the heating roller 14, and the fixing roller 11 as shown in FIG. 2, the separation aid 16 is substantially planar in cross-section.

The bulge 16*g* of the separation aid 16 is manufactured by a pressing process to reduce costs. The pressing process includes a process of cutting or molding the steel plate into a predetermined shape and a predetermined dimension under a force generated with a plurality of pairs of tools. For example, the pressing process includes shearing, raising, drawing, bending, forging, stretch forming, rotational molding, rubber and hydroforming, high-energy high-speed molding, embossing, and coining. However, the pressing process is not limited to those. The separation aid 16 is produced by treating a cold rolled steel plate with pressing and subsequent plating. Alternatively, the separation aid 16 may be produced by treating a cold rolled steel plate with plating and subsequent pressing. If the cold rolled steel plate is a rolled stainless steel plate, plating may be omitted for rustproofing. For example, plating is conducted with zinc, tin, chrome, nickel, or the like.

Figure 7:
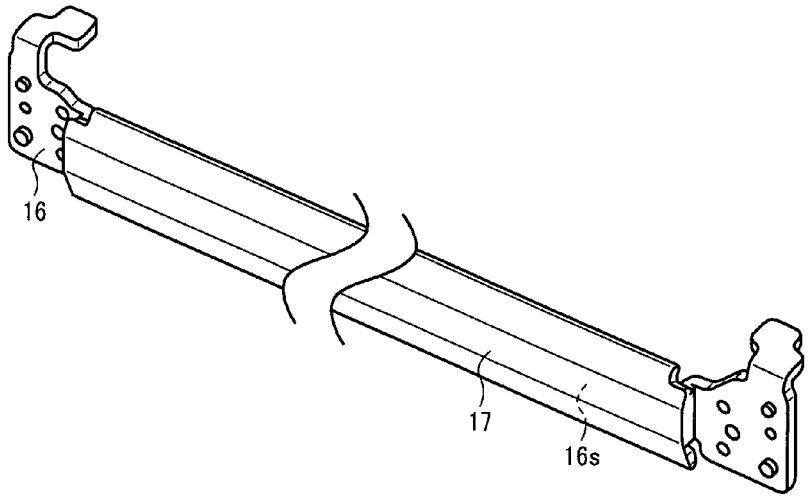
FIG. 7 is a front perspective view of the separation aid shown in FIG. 6 attached with a slide sheet.
Figure 8:
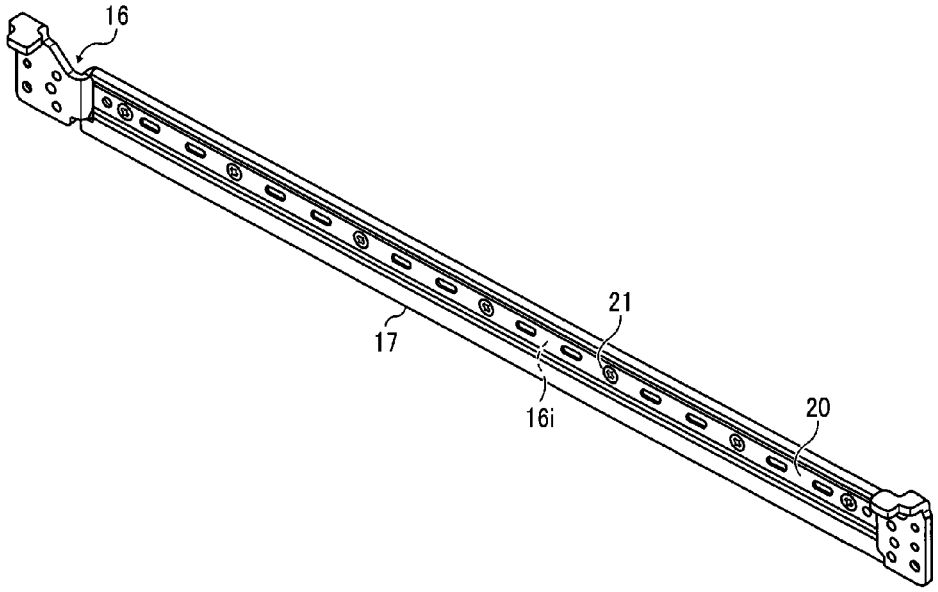
FIG. 8 is a rear perspective view of the separation aid shown in FIG. 6 attached with the slide sheet.

FIG. 7 is a front perspective view of the separation aid 16 attached with a slide sheet 17. FIG. 8 is a rear perspective view of the separation aid 16 attached with the slide sheet 17. As shown in FIGS. 7 and 8, the fibrous slide sheet 17 is mounted on the slide face 16*s* of the separation aid 16 to decrease a slide resistance or a friction between the separation aid 16 and the inner circumferential surface of the fixing belt 12 and therefore facilitate sliding of the fixing belt 12 over the separation aid 16. The slide sheet 17 is wound around the separation aid 16 such that the slide sheet 17 is layered on the interior face 16*i* of the separation aid 16 opposite the slide face 16*s*. A sheet metal 20 presses the slide sheet 17 against the interior face 16*i* of the separation aid 16. A screw 21 fastens the sheet metal 20 and the slide sheet 17 to the separation aid 16. The screw 21 includes a screw thread adhered with a thermosetting adhesive.

Figure 9:
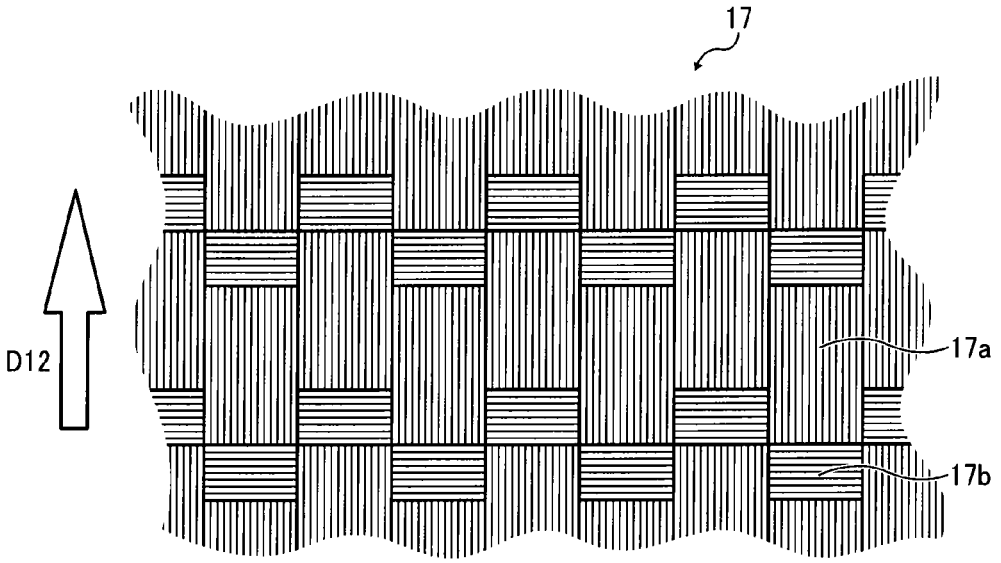
FIG. 9 is an enlarged view of a surface of the slide sheet shown in FIG. 7.

FIG. 9 is an enlarged view of a surface of the slide sheet 17. As shown in FIG. 9, the fibrous slide sheet 17 includes a warp portion 17*a* and a weft portion 17*b* to decrease the friction coefficient of the slide sheet 17 in the rotation direction D12 of the fixing belt 12. The warp portion 17*a* extending in the rotation direction D12 of the fixing belt 12 has an increased texture density. The weft portion 17*b* extending in the direction perpendicular to the rotation direction D12 of the fixing belt 12 has a decreased texture density.

Since the fibrous slide sheet 17 includes a fiber being susceptible to thermal contraction, the fiber is subject to a firing process at a temperature not lower than 180 degrees centigrade for 30 minutes or more and is processed into a predetermined shape.

Instead of mounting the slide sheet 17, the surface of the separation aid 16 may be treated with fluorine coating to attain the similar advantage of decreasing the friction coefficient although the durability of the slide sheet 17 degrades.

Thus, the image forming apparatus 200 incorporating the fixing device 100 improves separation of the sheet P from the fixing belt 12 for various types of the sheet P and the toner image T formed on the sheet P.

A description is provided of advantages of the fixing device 100.

As shown in FIG. 2, the fixing device 100 includes a first roller (e.g., the fixing roller 11) including the surface elastic layer 11A; a second roller (e.g., the heating roller 14) accommodating the heater 14*h*; the endless fixing belt 12 stretched taut across the first roller and the second roller and rotatable in a predetermined direction of rotation (e.g., the rotation direction D12); a pressure rotator (e.g., the pressure roller 13) disposed opposite and pressed against the first roller via the fixing belt 12 to form the fixing nip N between the pressure rotator and the fixing belt 12; and the separation aid 16 disposed opposite the inner circumferential surface of the fixing belt 12 and disposed downstream from the fixing nip N in the direction of rotation of the fixing belt 12. The separation aid 16 is disposed in proximity to the fixing nip N to decrease the radius of curvature of the fixing belt 12. As shown in FIGS. 3 and 6, the separation aid 16 includes a contact face (e.g., the slide face 16*s*) contacting the inner circumferential surface of the fixing belt 12 and the bulge 16*g* disposed at a center on the contact face in the longitudinal direction of the separation aid 16. The bulge 16*g* projects toward the inner circumferential surface of the fixing belt 12 relative to each lateral end of the contact face in the longitudinal direction of the separation aid 16. The separation aid 16 includes a cold rolled steel plate treated with pressing.

Accordingly, the separation aid 16 manufactured at reduced costs remains substantially planar with respect to the fixing belt 12 even if the separation aid 16 is exerted with tension from the fixing belt 12. Consequently, the fixing device 100 attains stable separation of the sheet P from the fixing belt 12 and enhanced quality of the toner image T formed on the sheet P.

As shown in FIG. 6, the bulge 16*g* projects toward the fixing belt 12 so that the slide face 16*s* of the separation aid 16 is substantially planar even if the separation aid 16 is elastically deformed by tension exerted from the fixing belt 12.

According to the exemplary embodiments described above, the fixing belt 12 serves as an endless fixing belt. Alternatively, a fixing film, a fixing sleeve, or the like may be used as an endless fixing belt. Further, the pressure roller 13 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a first roller including a surface elastic layer;

a second roller;

an endless fixing belt stretched taut across the first roller and the second roller and rotatable in a predetermined direction of rotation;

a pressure rotator pressed against the first roller via the fixing belt to form a fixing nip between the pressure rotator and the fixing belt, the fixing nip through which a recording medium is conveyed;

a separation aid disposed downstream from the fixing nip in the direction of rotation of the fixing belt to separate the recording medium from the fixing belt, the separation aid including:

a contact face contacting an inner circumferential surface of a segment of the fixing belt along which there is contact between the separation aid and the inner circumferential surface of the fixing belt, an outer circumferential surface of the segment of the fixing belt being exposed without contacting the pressure rotator; and a bulge disposed at a center of the contact face in a longitudinal direction of the separation aid, the bulge projecting toward the inner circumferential surface of the fixing belt relative to each lateral end of the contact face in the longitudinal direction of the separation aid; and a fibrous slide sheet mounted on the contact face of the separation aid to decrease a friction between the separation aid and the fixing belt, and the slide sheet includes:

a warp portion extending in the direction of rotation of the fixing belt and having an increased texture density; and a weft portion extending in a direction perpendicular to the direction of rotation of the fixing belt and having a decreased texture density smaller than the increased texture density of the warp portion.

2. The fixing device according to claim 1, wherein the separation aid is disposed in proximity to the fixing nip to decrease a radius of curvature of the fixing belt.

3. The fixing device according to claim 1, wherein the separation aid includes a cold rolled steel plate treated with pressing.

4. The fixing device according to claim 1, wherein the separation aid is treated with plating.

5. The fixing device according to claim 1, wherein the bulge projects toward the inner circumferential surface of the fixing belt relative to each lateral end of the separation aid in the longitudinal direction thereof by a height in a range of from 0.1 mm to 0.3 mm.

6. The fixing device according to claim 1, wherein the slide sheet further includes a fiber treated with firing at a temperature not lower than 180 degrees centigrade.

7. The fixing device according to claim 1, wherein the separation aid further includes an interior face opposite the contact face and mounting the slide sheet.

8. The fixing device according to claim 7, further comprising a sheet metal to press the slide sheet against the interior face of the separation aid.

9. The fixing device according to claim 8, further comprising a screw to fasten the sheet metal and the slide sheet to the separation aid.

10. The fixing device according to claim 1, wherein the separation aid further includes:

an interior face opposite the contact face; and a bent portion disposed at each lateral end of the separation aid in the longitudinal direction thereof and bent to project from the interior face in a direction in which the bent portion separates from the interior face.

11. The fixing device according to claim 1, wherein the separation aid further includes:

a base having a first thickness in a direction perpendicular to the direction of rotation of the fixing belt; and a front end being contiguous to the base and having a second thickness in the direction perpendicular to the direction of rotation of the fixing belt, the second thickness gradually decreasing relative to the first thickness of the base.

12. The fixing device according to claim 11, wherein the front end is disposed at an end of the contact face in the direction of rotation of the fixing belt and includes a curved face having a roundness defined by a radius in a range of from 1 mm to 3 mm.

13. The fixing device according to claim 1, wherein the pressure rotator includes a pressure roller.

14. The fixing device according to claim 1, wherein the separation aid does not form any fixing nip between the fixing belt and the pressure rotator.

15. A fixing device comprising:

a first roller including a surface elastic layer;

a second roller;

an endless fixing belt stretched taut across the first roller and the second roller and rotatable in a predetermined direction of rotation;

a pressure rotator pressed against the first roller via the fixing belt to form a fixing nip between the pressure rotator and the fixing belt, the fixing nip through which a recording medium is conveyed;

a separation aid disposed downstream from the fixing nip in the direction of rotation of the fixing belt to separate the recording medium from the fixing belt, the separation aid including:

a contact face contacting an inner circumferential surface of the fixing belt; and a bulge disposed at a center of the contact face in a longitudinal direction of the separation aid, the bulge projecting toward the inner circumferential surface of the fixing belt relative to each lateral end of the contact face in the longitudinal direction of the separation aid; and a fibrous slide sheet mounted on the contact face of the separation aid to decrease a friction between the separation aid and the fixing belt, and the slide sheet includes:

a warp portion extending in the direction of rotation of the fixing belt and having an increased texture density, and a weft portion extending in a direction perpendicular to the direction of rotation of the fixing belt and having a decreased texture density smaller than the increased texture density of the warp portion.

16. The fixing device according to claim 15, wherein the separation aid does not form any fixing nip between the fixing belt and the pressure rotator.

17. An image forming apparatus comprising:

a fixing device including:

a first roller including a surface elastic layer;

a second roller;

an endless fixing belt stretched taut across the first roller and the second roller and rotatable in a predetermined direction of rotation;

a pressure rotator pressed against the first roller via the fixing belt to form a fixing nip between the pressure rotator and the fixing belt, the fixing nip through which a recording medium is conveyed;

a separation aid disposed downstream from the fixing nip in the direction of rotation of the fixing belt to separate the recording medium from the fixing belt, the separation aid including:

a contact face contacting an inner circumferential surface of a segment of the fixing belt along which there is contact between the separation aid and the inner circumferential surface of the fixing belt, an outer circumferential surface of the segment of the fixing belt being exposed without contacting the pressure rotator; and a bulge disposed at a center of the contact face in a longitudinal direction of the separation aid, the bulge projecting toward the inner circumferential surface of the fixing belt relative to each lateral end of the contact face in the longitudinal direction of the separation aid; and a fibrous slide sheet mounted on the contact face of the separation aid to decrease a friction between the separation aid and the fixing belt, and the slide sheet includes:

a warp portion extending in the direction of rotation of the fixing belt and having an increased texture density; and a weft portion extending in a direction perpendicular to the direction of rotation of the fixing belt and having a decreased texture density smaller than the increased texture density of the warp portion.

18. The image forming apparatus according to claim 17, wherein the separation aid does not form any fixing nip between the fixing belt and the pressure rotator.

* * * * *